United States Patent [19]

Tanaka

[11] Patent Number: 4,677,696

[45] Date of Patent: Jul. 7, 1987

[54] DUST-FREE GARMENT FOR CLEAN ROOM

[75] Inventor: Norito Tanaka, Tokyo, Japan

[73] Assignee: Toyo Lint Free Co., Ltd., Tokyo, Japan

[21] Appl. No.: 931,612

[22] Filed: Nov. 17, 1986

[30] Foreign Application Priority Data

Apr. 18, 1986 [JP] Japan ..... 61-57545[U]

[51] Int. Cl.[4] ..... A41D 10/00; A41D 13/00

[52] U.S. Cl. ..... 2/84; 2/2

[58] Field of Search ..... 2/84, 80, 81, 79, 2, 2/82, 275, 69

[56] References Cited

U.S. PATENT DOCUMENTS 3,359,567 12/1967 Zemme et al. ..... 2/2

3,496,572 2/1970 Herzig ..... 2/2

4,272,851 6/1981 Goldstein ..... 2/79

*Primary Examiner*—Doris L. Troutman

*Attorney, Agent, or Firm*—Frishauf, Holtz, Goodman & Woodward

[57] ABSTRACT

A dust-free garment for clean rooms made of anti-static woven cloth and comprising a jacket, pants and a hood which are sewn together in a manner that a front part of the jacket and pants are formed with a continuous single piece of cloth without seams and facings in the front, an open/close member with a fastener is provided between the front and back of the pants along the insides of the legs and crotch thereof, seams between the jacket and the hood, between the front and back parts of the jacket and pants, between front and back parts of the jacket and sleeves, between right and left parts of the back at the center are covered with piping of pieces of tape attached from outside to maintain airtightness, and drawstrings are provided at the waist and neck along the back portions of the back and the hood to thereby securely prevent harmful dust generated from underwears or the skin of workers from leaking outside.

6 Claims, 4 Drawing Figures

DUST-FREE GARMENT FOR CLEAN ROOM

BACKGROUND OF THE INVENTION

1. Field of the Invention

This invention relates to an improvement for dust-free garments to be used in a special environment such as an industrial clean room in the electronic parts manufacturing industry or a bio-clean room in the food or pharmaceutical industry.

2. Description of the Prior Art

It has been known that dust-free garments are worn by workers in a special environment such as industrial clean rooms of manufacturers of semiconductors, integrated circuits, etc. or bio-clean rooms of the food or pharmaceutical industry.

This type of dust-free garment has recently been improved in anti-static property, sweat-absorbency and anti-stain property, along with the development of synthetic cloths of the polyester group, but still remains defective in sealing property as seams or facings on the garment do not have perfect sealing. Human discharge and waste, exfoliated from the skin of workers, bacteria or dust from underwear of workers tend to come out of the garments to thereby create a problem.

In order to facilitate convenience in taking on or off of the garments and to ease the movement of the heads of workers, the garments are generally provided with an open-close fastener at the center of the front of a jacket, and with a hood to cover heads separately from the jacket. As the fastener is not completely air-tight, dust from the underwear worn by a worker leaks out of the garment through interstices in the fastener every time the worker moves his upper body or dust leaks outside through the attachment of the hood to thereby contaminate the environment.

SUMMARY OF THE INVENTION

This invention aims to provide a dust-free garment which can prevent as much as possible leakage of harmful dust as they inevitably come out of the skin or underwear of a worker to outside.

In order to achieve the above object, according to this invention, a jacket, pants and a hood are made of an anti-static woven material and sewn together. This front part of the jacket and of pants is formed with one continuous sheet of fabric without seams or facings, a fastener closure member is provided between the front and back parts of the pants extending from a hem of one leg to the crotch then to the hem of the other leg. The seams between the jacket and the hood, between the front and back parts of the jacket and the pants, between the front and back of the jacket and sleeves, and the central seam of the right and left parts of the back are covered by piping with an airtight tape attached from outside. Drawstrings are attached on the center of the back part and the back of the hood. All these improvements contribute to enhancing the sealing effect so as to prevent harmful dust from coming out and leaking out of the underwear or the skin of workers.

PREFERRED EMBODIMENT OF THE INVENTION

The dust-free garment according to this invention will now be described referring to a preferred embodiment shown in attached drawings.

Figure 1:
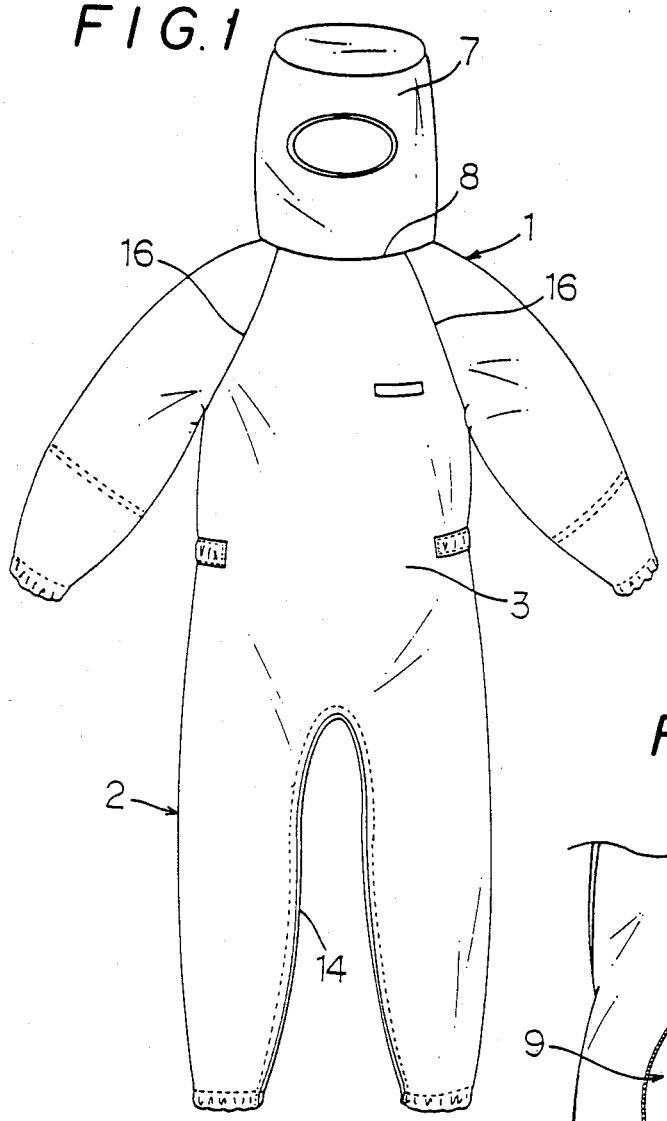
FIG. 1 is a frontal view of a preferred embodiment of the dust-free garment according to this invention.
Figure 3:
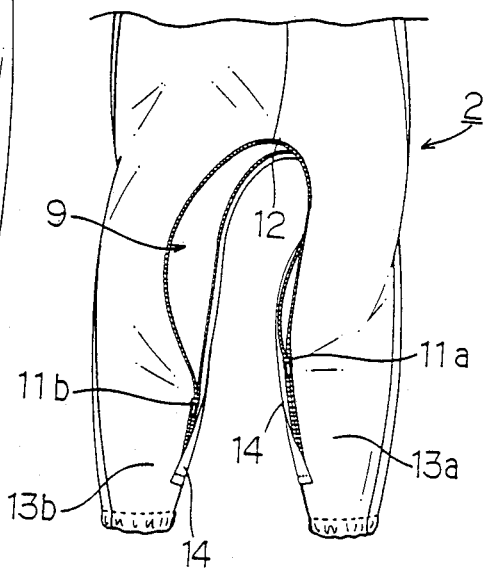
FIG. 3 is a partial perspective view to show the structure of the closure fastener of the pants of the dust-free garment shown in FIG. 1.
Figure 2:
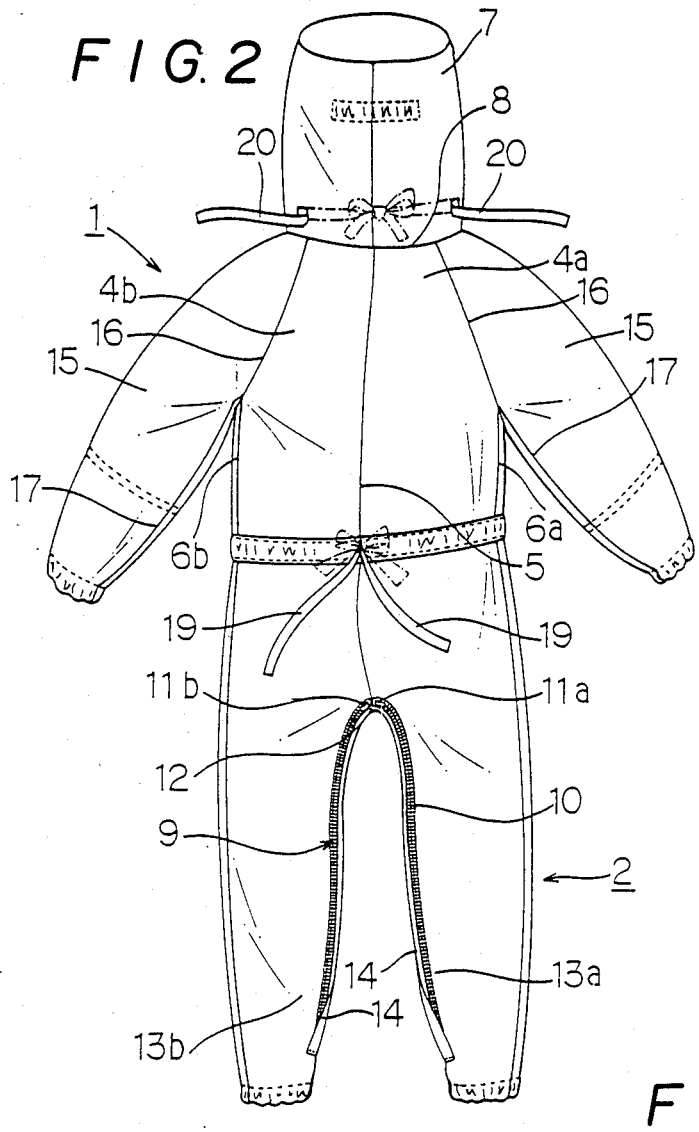
FIG. 2 is a rear view of the dust-free garment shown in FIG. 1.

FIG. 1 is a frontal view and FIG. 2 is a rear view of a dust-free garment respectively.

As is clear from the figures, the dust-free garment according to the present invention comprises the front part 3 of a jacket 1 and of pants 2 and back parts 4*a*, 4*b* which are formed respectively with one single continuous sheet of fabric without lateral seams. This means that there are no seams and fasteners on the front panel 3 or more particularly, at breast and waist portions which might otherwise become the outlets of dust.

In the back part, the jacket 1 and pants 2 are each made of a pair of single continuous fabric pieces 4*a*, 4*b* which are sewn together at the center of the back at the seam 5. The sewn pieces are then attached to the front body 3 on both sides thereof at side seams 6*a*, 6*b*.

The hook 7 is sewn to the front panel 3 of the jacket 1 and the upper ends of the back panel 4*a*, 4*b*.

The open-close portion 9 for taking on/off a dust-free garment is provided by a slide fastener 10 (see FIG. 2) attached on the pants 2 to extend from the hem of a leg 13*a*, to the crotch 12 to again the hem of the other leg 13*b* along the inside of the legs of the pants or more particularly, between the front 3 and the back portions of 4*a*, 4*b* of the pants 2. The slide fastener 10 can be opened from either side with sliders 11*a*, 11*b*. The open-close portion 9 is also provided with a flap 14 on the side of the front 3 so that the flap 14 can cover the outer surface of the slide fastener 10 when closed. This further prevents dust from leaking from interstices of the slide fastener 10 to outside.

Figure 4:
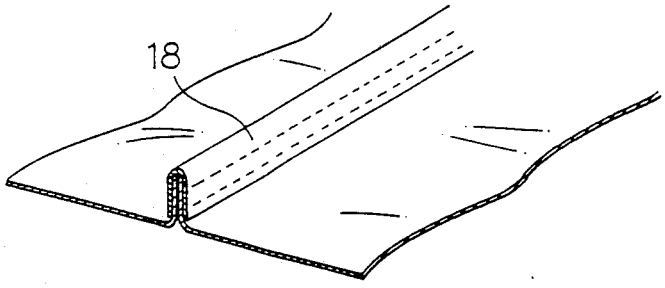
FIG. 4 is a partial perspective view to show the structure of respective parts of the dust-free garment shown in FIG. 1.

The dust-free garment of the present invention is formed in such a manner as to keep airtightness on all the seamed portions of the material. More specifically, all the seams including the center seam 5 between the right and left sides 4*a*, 4*b* of the back, the side seams 6*a*, 6*b* between the sides of the front 3 and the left and right sides 4*a*, 4*b* of the rear, the seam 8 between the hood 7 and the jacket 1, the seams 16 between the jacket 1 and hood 7 and the right and left sleeves 15, and the seams 17 at the undersides of the sleeves are covered with piping of pieces of tape 18 as shown in FIG. 4 to secure airtightness over the seams.

Drawstrings 19, 20 are attached at the center on the back as well as the hood 7 respectively.

When a worker is about to don the dust-free garment of the invention, he first pulls down the sliders 11*a*, 11*b* of the fastener closure member 10 toward the hems 13*a*, 13*b* to release the closure, and then puts the garment over his head to let his head go through the top opening into hook 7 and to place his upper body inside the jacket 1.

Then the worker puts both legs through the cuffs of both leg ends 13*a*, 13*b* of the pants 2, places his lower body inside the pants 2, then pulls up the sliders 11*a*, 11*b* from their positions at the cuffs 13*a*, 13*b* toward the crotch 12 to close the fastener 10 to close the open-close portion 9, and then covers the fastener 10 with the flap 14.

Then he draws the drawstrings 19, 20 at the waist and at the neck respectively.

As the dust-free garment of the present invention is formed to make an integrated front part for the jacket 1 and pants 2 with a single sheet of cloth without seams, closures or any other joints, when the worker performs work at a sedentary position and moves his upper body, dust inside the garment is securely prevented from leaking out through the front part with such a structure.

As the hood 7 is sewn to the jacket 1 in a continuous and integrated member, there is no interstice between the hood 7 and the jacket 1, this completely preventing dust from leaking from inside to outside.

All the seams and joints 5, *6a*, *6b*, 16 and 17 between pieces of cloth including the seam between the jacket 1 and the hook 7 are covered with piping of tape 18 attached from outside over the seams. This makes all the seams and joints highly airtight. As the material has anti-static property, the dust-free garment of the present invention can securely prevent dust from leaking from inside to outside.

Although the above description relates to a preferred embodiment of the invention, the present invention is not limited to the above embodiment but can naturally be modified by those skilled in the art by various designs without deviating from the spirit of this invention.

What is claimed is:

1. A dust-free garment for clean rooms, comprising:

a jacket portion having sleeves, a pants portion having legs and a crotch portion, and a hood portion which are sewn together and made from synthetic woven cloth having an anti-static property, said jacket portion and said pants portion each having a front part and a back part, the front part of said jacket portion and pants portion being formed with one single continuous piece of cloth without seams or facings therein;

an open-close portion provided along the insides of both legs and the crotch of the pants;

fastener means coupled to said open-close portion of the garment for selectively opening and closing said open-close portion;

seams between said jacket portion and said hood portion, between the front part and back parts of said jacket and pants portions, between front and back parts of said jacket portion and said sleeves, and between right and left back parts at the center of the back, being covered with piping of pieces of tape attached from the outside of the garment to keep airtightness;

a first drawstring provided at the waist of the garment along the center of a back portion of the garment; and a second drawstring provided at a neck portion of the garment along the back side of said hood portion.

2. The dust-free garment of claim 1, wherein said fastener means comprises an elongated slide fastener means having at least one slider member for opening and closing said slide fastener means to open and close said open-close portion of the garment.

3. The dust-free garment of claim 2, wherein said slide fastener means comprises a pair of said slider members which are operable from respective opposite ends of said slide fastener means.

4. The dust-free garment of claim 3, wherein said open-close portion includes a flap for covering said slide fastener means when it is closed.

5. The dust-free garment of claim 2, wherein said open-close portion includes a flap for covering said slide fastener means when it is closed.

6. The dust-free garment of claim 1, wherein said open-close portion includes a flap for covering said slide fastener means when it is closed.

* * * * *